US009528779B2

(12) United States Patent
Lee et al.

(10) Patent No.: US 9,528,779 B2
(45) Date of Patent: Dec. 27, 2016

(54) HEAT EXCHANGER

(71) Applicant: LG Electronics Inc., Seoul (KR)

(72) Inventors: Sangyeul Lee, Seoul (KR); Hongseong Kim, Seoul (KR); Juhyok Kim, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 635 days.

(21) Appl. No.: 13/955,848

(22) Filed: Jul. 31, 2013

(65) Prior Publication Data

US 2014/0034271 A1 Feb. 6, 2014

(30) Foreign Application Priority Data

Aug. 1, 2012 (KR) ..... 10-2012-0084515

(51) Int. Cl.

| | |
|---|---|
| ***F28F 13/00*** | (2006.01) |
| ***F28F 17/00*** | (2006.01) |
| ***F28F 1/32*** | (2006.01) |
| *F28D 1/047* | (2006.01) |

(52) U.S. Cl.

CPC ..... *F28F 13/00* (2013.01); *F28F 1/325* (2013.01); *F28F 17/00* (2013.01); *F28D 1/0477* (2013.01)

(58) Field of Classification Search

CPC ..... F28F 1/00; F28F 1/325; F28F 17/00; F28F 13/00; F28D 1/0477

USPC ..... 165/151, 182, 181

See application file for complete search history.

(56) References Cited

U.S. PATENT DOCUMENTS

| | | | | | |
|---|---|---|---|---|---|
| 4,705,105 | A | * | 11/1987 | Cur | F28F 1/325 165/151 |
| 5,042,576 | A | | 8/1991 | Broadbent | |
| 5,509,469 | A | | 4/1996 | Obosu | |
| 5,692,561 | A | * | 12/1997 | Kang | F28F 1/325 165/151 |
| 5,794,690 | A | * | 8/1998 | Kim | F28F 1/325 165/151 |
| 5,887,649 | A | * | 3/1999 | Kim | F28F 1/325 165/146 |
| 5,890,532 | A | * | 4/1999 | Kim | F28F 1/325 165/151 |
| 5,915,471 | A | * | 6/1999 | Kim | F28F 1/325 165/151 |
| 5,927,392 | A | * | 7/1999 | Youn | F28F 1/325 165/151 |
| 5,975,199 | A | * | 11/1999 | Park | F28F 1/325 165/151 |

(Continued)

FOREIGN PATENT DOCUMENTS

| | | | |
|---|---|---|---|
| CN | 1186932 | A | 7/1998 |
| CN | 1188228 | A | 7/1998 |

(Continued)

*Primary Examiner* — Tho V Duong
*Assistant Examiner* — Raheena Rehman
(74) *Attorney, Agent, or Firm* — Dentons US LLP

(57) ABSTRACT

Provided is a heat exchanger. The heat exchanger includes a refrigerant tube through which a refrigerant flows and a fin having at least two tube through holes in which the refrigerant tube is inserted. The fin includes a fin body, a plurality of louvers protruding from a surface of the fin body, a plane part defined between the plurality of louvers, the plane part having a flat surface, and a guide part disposed on at least one side of the plane part to guide a flow of air or discharge of defrosting water.

7 Claims, 13 Drawing Sheets

(56) References Cited

U.S. PATENT DOCUMENTS

| | | | | |
|---|---|---|---|---|
| 6,431,263 | B2 * | 8/2002 | Oh | 165/151 |
| 6,786,274 | B2 * | 9/2004 | Bemisderfer | F28F 1/325 165/151 |
| 7,021,370 | B2 * | 4/2006 | Papapanu | F28F 1/325 165/151 |
| 7,578,339 | B2 * | 8/2009 | Kaga | F28F 1/325 165/109.1 |
| 2005/0241813 | A1 * | 11/2005 | Choi | F28F 1/325 165/151 |
| 2007/0151716 | A1 * | 7/2007 | Lee | F28F 17/005 165/151 |
| 2009/0050303 | A1 * | 2/2009 | Komori | F28F 1/325 165/151 |
| 2009/0084129 | A1 * | 4/2009 | Kim | F25B 39/00 62/502 |
| 2009/0308585 | A1 * | 12/2009 | Chen | F28D 1/0475 165/185 |
| 2010/0205993 | A1 * | 8/2010 | Matsuda | F24F 1/0059 62/259.1 |
| 2011/0120681 | A1 * | 5/2011 | Seo | F24F 13/30 165/151 |
| 2011/0168383 | A1 * | 7/2011 | Davis | E21B 37/02 166/173 |
| 2012/0175101 | A1 * | 7/2012 | Tamura | F24F 1/18 165/181 |

FOREIGN PATENT DOCUMENTS

| | | | |
|---|---|---|---|
| CN | 1809722 | A | 7/2006 |
| GB | 2350669 | A | 6/2000 |
| KR | 10-2005-0023759 | A | 3/2005 |

* cited by examiner

HEAT EXCHANGER

CROSS-REFERENCE TO RELATED APPLICATIONS

The present application claims priority under 35 U.S.C. 119 and 35 U.S.C. 365 to Korean Patent Application No. 10-2012-0084515 filed on Aug. 1, 2012, which is hereby incorporated by reference in its entirety.

BACKGROUND

The present disclosure relates to a heat exchanger.

Heat exchangers are components that constitute a refrigeration cycle. Also, heat exchangers are configured to allow a refrigerant to flow therein. Heat exchangers may cool or heat air through heat exchange with the air. Such a heat exchanger may be used in a freezing device for an air conditioner, a refrigerator, or the like. Here, the heat exchanger may serve as a condenser or an evaporator according to whether a refrigerator is condensed or evaporated by the heat exchanger.

In detail, the heat exchanger includes a tube through which the refrigerant flows and a fin that is coupled to the tube to increase an area between the refrigerant within the tube and air, i.e., a heat exchange area. A plurality of through holes may be defined in the fin so that the tube is inserted into the through holes.

The fin may be provided in plurality. The plurality of fins may be stacked along an extending direction of the tube. A predetermined space may be defined between the stacked fins. Thus, air may be heat-exchanged with the refrigerant of the tube while flowing into the predetermined space.

A structure for increasing the heat exchange area, i.e., a louver may be provided on the fin. The louver may be formed by cutting and bending a portion of the fin. The louver may be provided on a plurality of areas of the entire surface area of the fin except for the through hole. A distance (stacked distance) between the stacked fins may decrease by the louver.

In the heat exchanger according to the related art, when the heat exchanger is used as the evaporator in the outside having a low temperature, condensed water may be frozen and thus implanted to a surface of the fin. Particularly, in the case where the louver is provided on the fin, the space between the fins may be blocked by frost. That is, since a passage through which air flows is blocked, heat exchange efficiency may be deteriorated. Also, a time required for defrosting of the heat exchanger may increase.

Particularly, when the heat exchanger is used in an air conditioner, since a heating operation of the air conditioner is restricted while a defrosting process of the air conditioner is performed, heating performance of the air conditioner may be deteriorated.

SUMMARY

Embodiments provide a heat exchanger having improved heat transfer performance and defrosting performance.

In one embodiment, a heat exchanger includes: a refrigerant tube through which a refrigerant flows; and a fin having a plurality of tube through holes in which the refrigerant tube is inserted, wherein the fin includes: a fin body; a plurality of louvers protruding from a surface of the fin body; a plane part defined between the plurality of louvers, the plane part having a flat surface; and a guide part disposed on at least one side of the plane part to guide a flow of air or discharge of defrosting water.

In another embodiment, a heat exchanger includes: a refrigerant tube through which a refrigerant flows; and a fin including a fin body having a tube through hole in which the refrigerant tube is inserted, wherein the fin includes: a plurality of first louvers disposed on one side with respect to a center of the tube through hole to protrude from the fin body; a plurality of second louvers disposed on an opposing side with respect to the center of the tube through hole to protrude from the fin body; a first plane part defined between each of the first louvers and each of the second louvers to define a flat surface; a second plane part between the plurality of first louvers or between the plurality of second louvers to define a flat surface; and a guide part disposed on the first plane part or the second plane part, the guide part having an inclined surface for guiding a flow of air or discharge of defrosting water.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
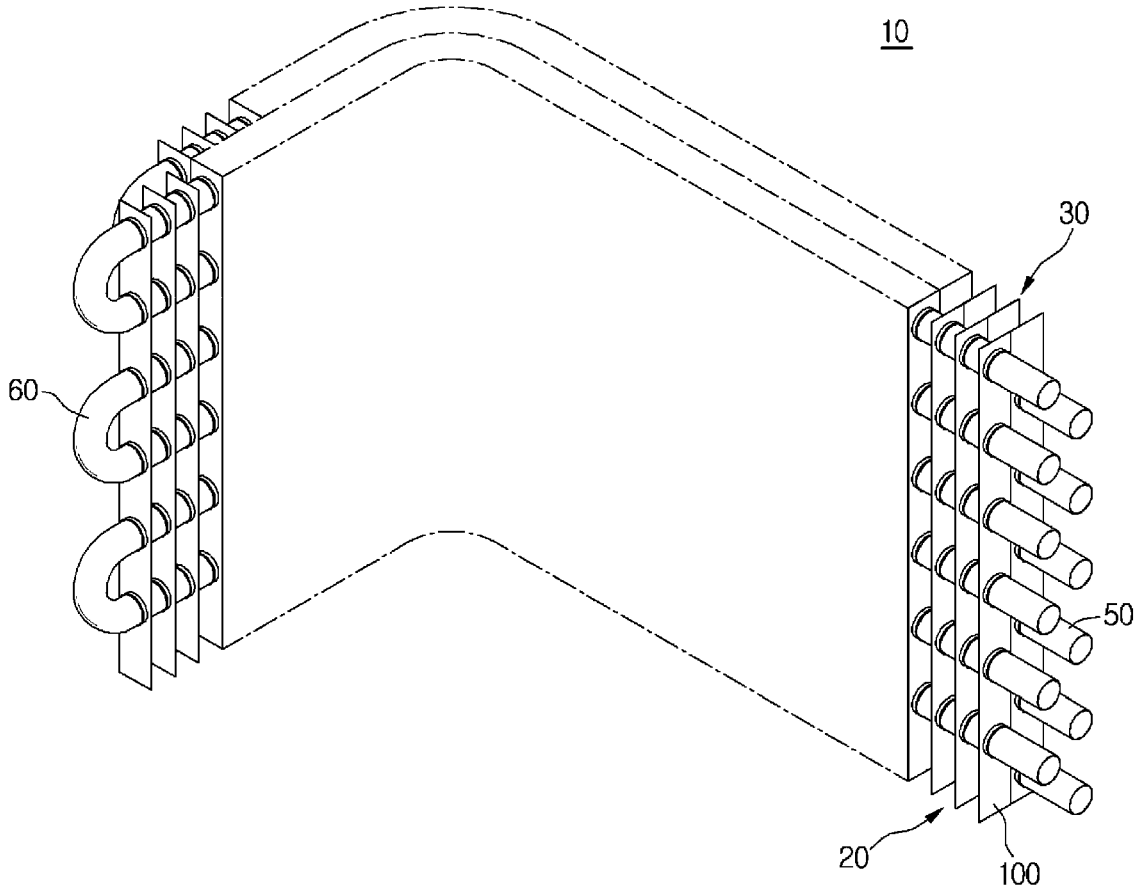
FIG. 1 is a perspective view of a heat exchanger according to an embodiment.

FIG. 1 is a perspective view of a heat exchanger according to an embodiment.

Referring to FIG. 1, a heat exchanger 10 according to an embodiment includes a first heat exchange part 20 and a second heat exchange part 30 which are disposed parallel to each other. The first heat exchange part 20 and the second heat exchange part 30 may be understood as a structure in which heat exchange parts are parallely disposed in two rows.

Each of the first and second heat exchange parts 20 and 30 includes a refrigerant tube 50 and a fin 100. The refrigerant tube 50 may be a tube for guiding a flow of a refrigerant. The refrigerant tube 50 may be formed of a metal such as aluminum or copper.

Also, the refrigerant tube 50 may be provided in plurality. The plurality of refrigerant tubes 50 may be vertically stacked on each other. Also, the plurality of refrigerant tubes 50 may be connected to each other by a return band 60. A refrigerant flowing in one direction through one refrigerant tube 50 of the plurality of refrigerant tubes 50 may be switched in flow in the other direction by passing through the return band 60 to flow into the other refrigerant tube 50.

The fin 100 may be fitted into the outside of the refrigerant tube 50 to increase a heat exchange area between the refrigerant tube 50 and air. Hereinafter, a fin 100 will be described with reference to the accompanying drawings.

Figure 2:
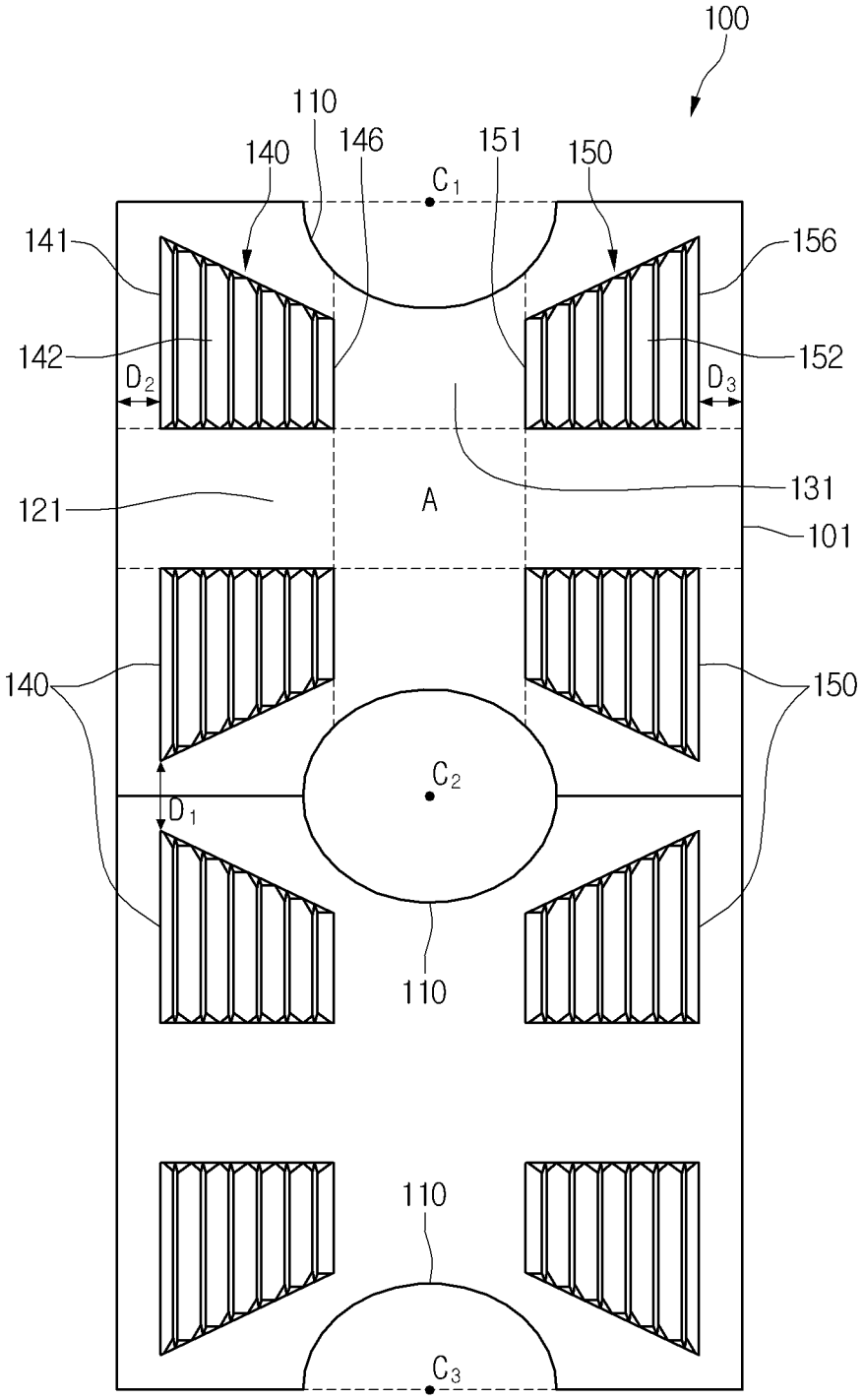
FIG. 2 is a view of a fin according to a first embodiment.
Figure 3:
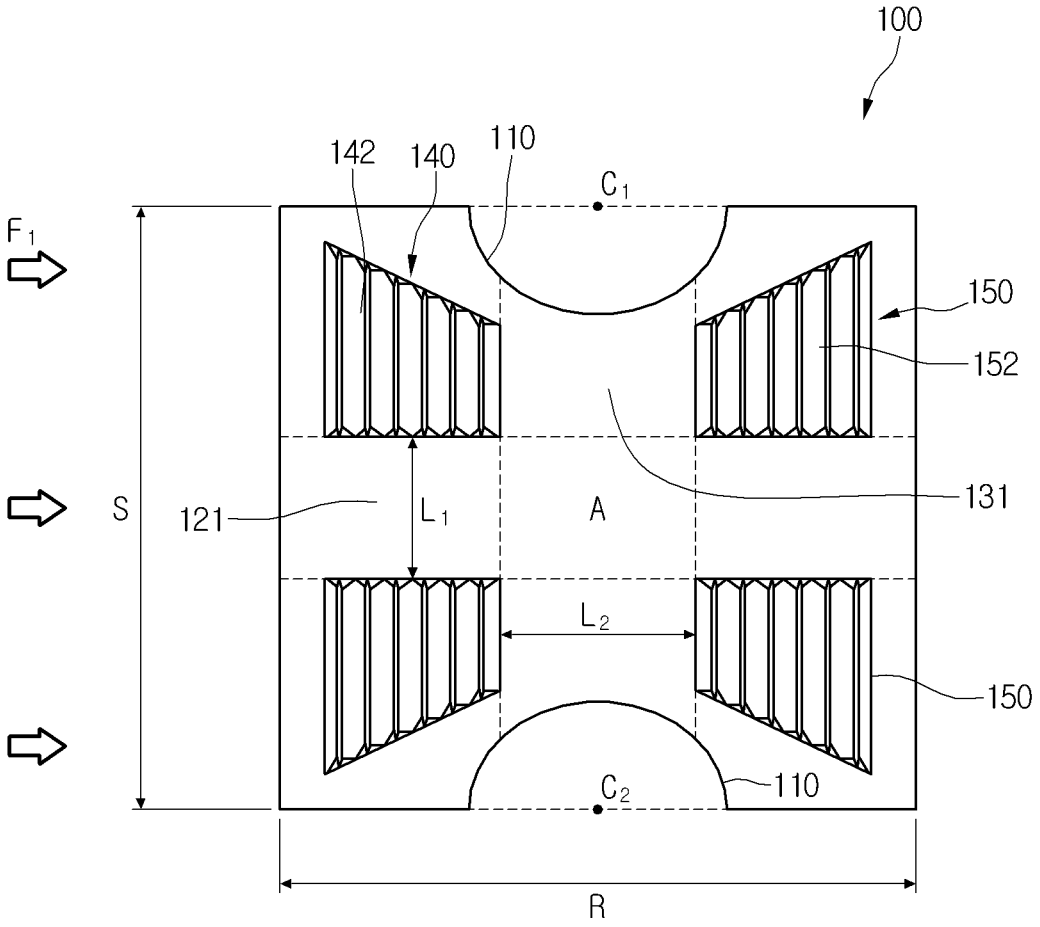
FIG. 3 is a view illustrating a plane part of the fin according to the first embodiment.

FIG. 2 is a view of a fin according to a first embodiment, and FIG. 3 is a view illustrating a plane part of the fin according to the first embodiment.

Referring to FIGS. 2 and 3, the fin 100 according to the first embodiment includes a fin body 101 having a predetermined heat exchange area, a plurality of tube through holes 110 defined in at least one portion of the fin body 101 and through which a refrigerant tube 50 is inserted, and a plurality of flow guides 140 and 150 disposed adjacent to the tube through holes 110 to guide a flow of air.

The plurality of tube through holes 110 are spaced apart from each other and arranged in a longitudinal direction (or length direction) of the fin 100. For convenience of description, a center of the tube through hole 110 defined in the uppermost side in FIG. 2 is called a center C1, and centers of the tube through holes 110 successively defined downward from the center C1 are called centers C2 and C3, respectively.

The plurality of flow guides 140 and 150 include a first flow guide 140 and a second flow guide 150 which are respectively disposed on one side and the other side of each of the centers C1, C2, and C3. The first and second flow guides 140 and 150 may be disposed to face each other on sides opposite to each other with respect to each of the centers C1, C2, and C3.

For example, as shown in FIG. 2, the first flow guide 140 may be disposed on a left side of each of the centers C1, C2, and C3, and the second flow guide 150 may be disposed on a right side of each of the centers C1, C2, and C3.

The first flow guide 140 may be provided in plurality. The plurality of first flow guides 140 are spaced apart from each other in a longitudinal direction of the fin 100. The first flow guides 140 are disposed on left upper and lower sides of the one tube through hole 110. For example, the first flow guides 140 may be disposed on left upper and lower sides of the tube through hole 110 having the center C2.

That is to say, when virtual horizontal and vertical lines passing through the center C2 by using the center C2 as the origin are respectively defined as an X-axis and a Y-axis, the first flow guides 140 may be disposed on a second quadrant and a fourth quadrant, respectively. Also, a lower end of the first flow guide 140 disposed on the second quadrant and an upper end of the first flow guide disposed on the fourth quadrant are spaced a predetermined distance D1 from each other.

Each of the first flow guides 140 may have a polygonal shape. For example, as shown in FIG. 2, each of the first flow guides 140 may have a trapezoid shape.

When considering that an air flow F (see FIG. 3) is oriented from a left side of the fin 100 toward a right side, a first front end 141 is disposed on a left end of the first flow guide 140, and a first rear end 146 is disposed on a right end of the first flow guide 140. The first front end 141 and the left end of the fin 100 may be spaced a predetermined distance D2 from each other.

The second flow guide 150 is symmetrical to the first flow guide 140 with respect to a virtual central line of the longitudinal direction of the fin 100. Here, the virtual central line of the longitudinal direction (hereinafter, referred to as a longitudinal central line) of the fin 100 may be understood as a virtual line connecting the centers C1, C2, and C3 to each other.

A second front end 151 is disposed on a left end of the second flow guide 150, and a second rear end 156 is disposed on a right end of the second flow guide 150.

The second front end 151 is disposed at a position symmetrical to that of the first front end 141 with respect to the longitudinal central line. The second rear end 156 is disposed at a position symmetrical to that of the first rear end 146 with respect to the longitudinal central line. Thus, the second rear end 156 and the right end of the fin 100 are spaced a predetermined distance D3 from each other. The distances D2 and D3 may be the same.

The first flow guide 140 includes a first louver 142 including a portion that protrudes from one surface or the other surface of the fin 100. Here, the one surface may be a top surface of the fin 100 shown in FIG. 2, and the other surface maybe a surface (a surface opposite to the surface shown in FIG. 2) opposite to the one surface.

At least one portion of the fin 100 may be cut and then bent in one and the other directions of the fin 100 to manufacture the first louver 142. The first louver 142 may increase a contact area between air and the fin 100. Here, the one direction may be a front side of the fin 100, and the other direction may be a rear side of the fin 100. The first louver 142 may be provided in plurality. The plurality of first louvers 142 may be disposed in the longitudinal direction of the fin 100.

Air may flow along the first louver 142 while passing through a side of the fin 100. For example, the air may flow from the one surface toward the other surface or from the other surface toward the one surface along the first louver 142.

The second flow guide 150 includes a second louver 152. The second louver 152 may have a shape similar to that of the first louver 142. Also, the second louver 152 may be provided in plurality. The plurality of second louvers 142 are spaced apart from each other in the longitudinal direction of the fin 100. Also, the second louver 152 is symmetrical to the first louver 142 with respect to the longitudinal central line of the fin 100.

The fin 100 includes a first plane part 121 extending in a transverse direction (or a width direction) of the fin 100 to define a flat surface and a second plane part 131 extending in the longitudinal direction (or a length direction) of the fin 100 to define a flat surface. The first and second plane parts 121 and 131 may be different from the first and second louver 142 or the second louver 153 in that each of the first and second plane parts 121 and 131 has a smooth surface.

The first plane part 121 is disposed between the plurality of tube through holes 110. In other words, the first plane part 121 may be disposed between the center C1 of the one tube through hole 110 and the center C2 of the other tube through hole 110.

The first plane part 121 may extend from the left end to the right end of the fin 100. Here, the extending direction of the first plane part 121 may correspond or parallel to the flow direction of the air passing through the plurality of fins 100 (see F1 of FIG. 3).

The first plane part 121 is disposed in a space between the plurality of first louvers 142. Also, the first plane part 121 may be disposed in a space between the plurality of second louvers 152. That is, the first and second louvers 142 and 152 may not be provided on the entire area of the fin 100. Also, the first louvers 142 may be partitioned by the first plane part 121, and the second louvers 152 may be partitioned by the first plane part 121.

Referring to FIG. 3, a width L1 in a longitudinal direction of the first plane part 121 corresponds to a distance spaced between the plurality of first louvers 142 that are disposed longitudinally or a distance spaced between the plurality of second louvers 152 that are disposed longitudinally. An amount of heat-exchange in the fin 100 and an operation time of a heat exchanger before a defrosting operation is performed may vary according to a size of the longitudinal width L1 (see FIG. 6). Here, the longitudinal width L1 may be decided to one value less than a distance S from the center C1 of the one tube through hole 110 to the center C2 of the other tube through hole 110.

Since the first plane part 121 is defined on a surface of the fin 100, the distance between the stacked fins 100 may increase. Thus, air may sufficiently flow through the increased space to delay implantation of frost.

The second plane part 131 is disposed between the plurality of tube through holes 110. In other words, the second plane part 131 may be disposed between the center C1 of the one tube through hole 110 and the center C2 of the other tube through hole 110.

The second plane part 131 may extend from an outer surface of the one tube through hole 110 to an outer surface of the other tube through hole 110. Here, the extending direction of the second plane part 131 may correspond to a direction in which defrosting water is discharged during the defrosting due to the gravity. Also, the second plane part 131 may be understood as a plane connecting the one tube through hole 110 to the other tube through hole 110.

For example, the second plane part 131 may extend in a direct downward direction.

The second plane part 131 may extend longitudinally along a space between the first louver 141 and the second louver 152. Thus, the first and second louvers 142 and 152 may be partitioned by the first plane part 121.

Referring to FIG. 3, a width L2 in a transverse direction of the second plane part 131 may corresponds to a distance spaced between the first and second louvers 142 and 152 that are transversely disposed spaced apart from each other. The amount of heat-exchange in the fin 100 and the operation time of a heat exchanger until the defrosting operation is performed may vary according to a size of the transverse width L2 (see FIG. 7).

Here, the transverse width L2 may be decided to one value less than a distance R from one end (e.g., a left end of FIG. 3) of the fin 100 to the other end (e.g., a right end of FIG. 3). The R may be understood as a transverse length of the fin 100.

Since the second plane part 131 is defined on the surface of the fin 100, the defrosting water generated during the defrosting may be quickly discharged downward to reduce a defrosting time, thereby improving operation efficiency of the heat exchanger and efficiency of a heating operation of the air conditioner including the heat exchanger.

Each of the first and second plane parts 121 and 131 may define at least one portion of one surface of the fin body 101. Also, the first and second plane parts 121 and 131 are disposed crossing each other to share a predetermined area thereof. In detail, as shown in FIG. 3, the first and second plane parts 121 and 131 may extend crossing each other to share a predetermined area that corresponds to an area "A" of the entire area of the fin body 101.

Also, the first and second plane parts 121 and 131 may cross each other at a predetermined angle. The predetermined angle may be decided to one of angles greater than 0 degree and less than 90 degrees.

For example, the first and second plane parts 121 and 131 may vertically cross each other. Also, centers of the first and second plane parts 121 and 131 may cross each other to form a cross shape.

Figure 4:
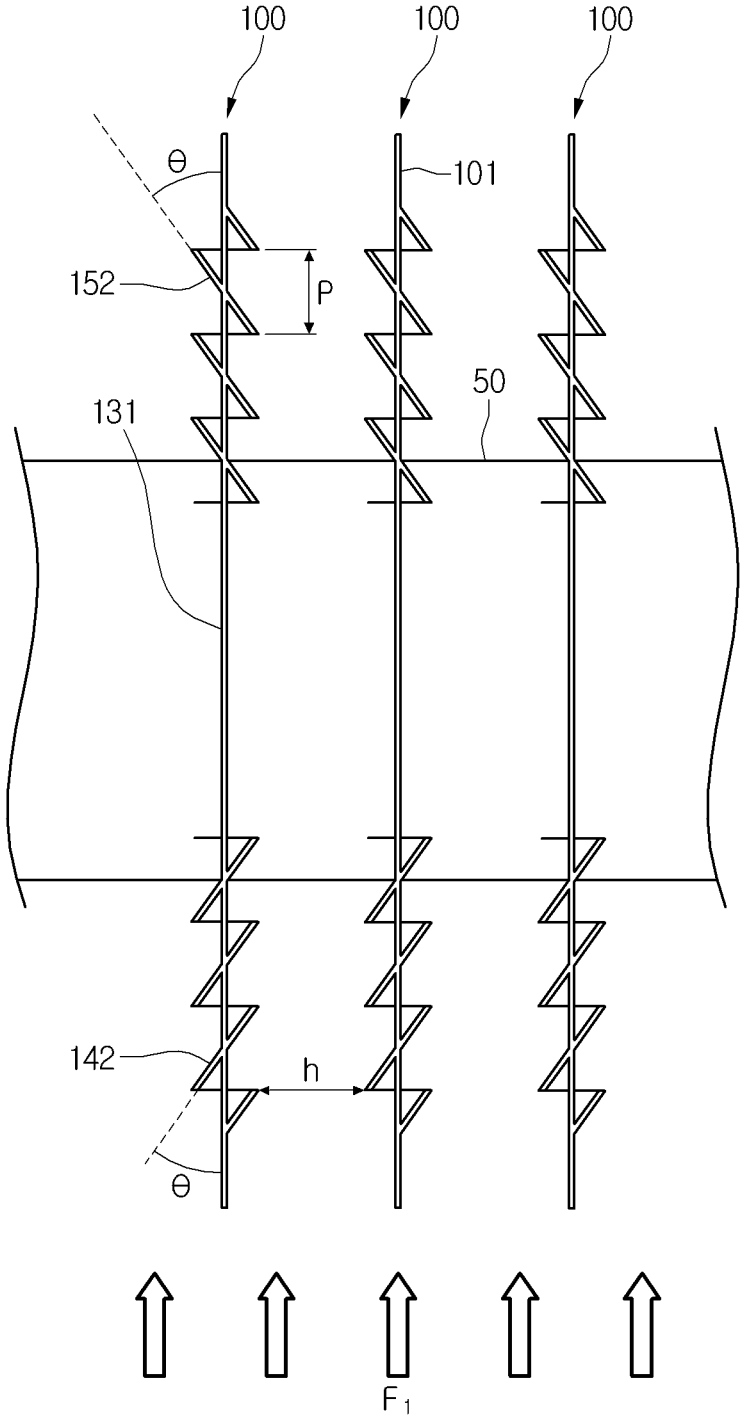
FIG. 4 is a view of a state in which a refrigerant tube and the fin are coupled to each other according to the first embodiment.

FIG. 4 is a view of a state in which a refrigerant tube and the fin are coupled to each other according to the first embodiment.

Referring to FIG. 4, the plurality of fins 100 may be spaced apart from each other and successively stacked on each other. FIG. 4 may be understood as a view when the heat exchanger 10 in which the refrigerant tube 50 and the plurality of fins 100 are coupled to each other is viewed from an upper side.

Each of the fins 100 includes the first and second louvers 142 and 152 which are partitioned by the second plane part 131. Air may be introduced from one end of the fin 100 to pass through the first louver 141, the second plane part 131, and the second louver 152 (F1). Also, as described above, at least one portion of the air may flows from the one end of the fin 100 toward the other end along the first plane part 121.

The first and second louvers 142 and 152 may protrude from one surface of the fin body 101 to the other surface to inclinedly extend at a set angle θ with respect to the fin body 101. The set angle θ may be called a "louver angle". As described above, the first and second louvers 142 and 152 may have the same shape as each other.

Also, a horizontal distance (a longitudinal distance in FIG. 4) from the one end of the first or second louver 142 or 152 to the other end is referred to as a pitch P, and a distance between one fin 100 and the other fin 100 adjacent to the one fin 100 is referred to as a fin distance h. Here, the fin distance h may be understood as a distance between an end of each of the louvers 142 and 152 disposed on the one fin 100 and an end of each of the louvers 142 and 152 disposed on the other fin 100 adjacent to the one end.

To delay the implantation of the frost in the heat exchanger 10, the fin distance h may be greater than a predetermined value. Here, if the fin distance h is too large, heat transfer performance through the fins 100 may be deteriorated. Thus, the fin distance h should be set within an adequate range. The selection of an adequate value with respect to the fin distance h will be described with reference to FIG. 8.

Figure 5:
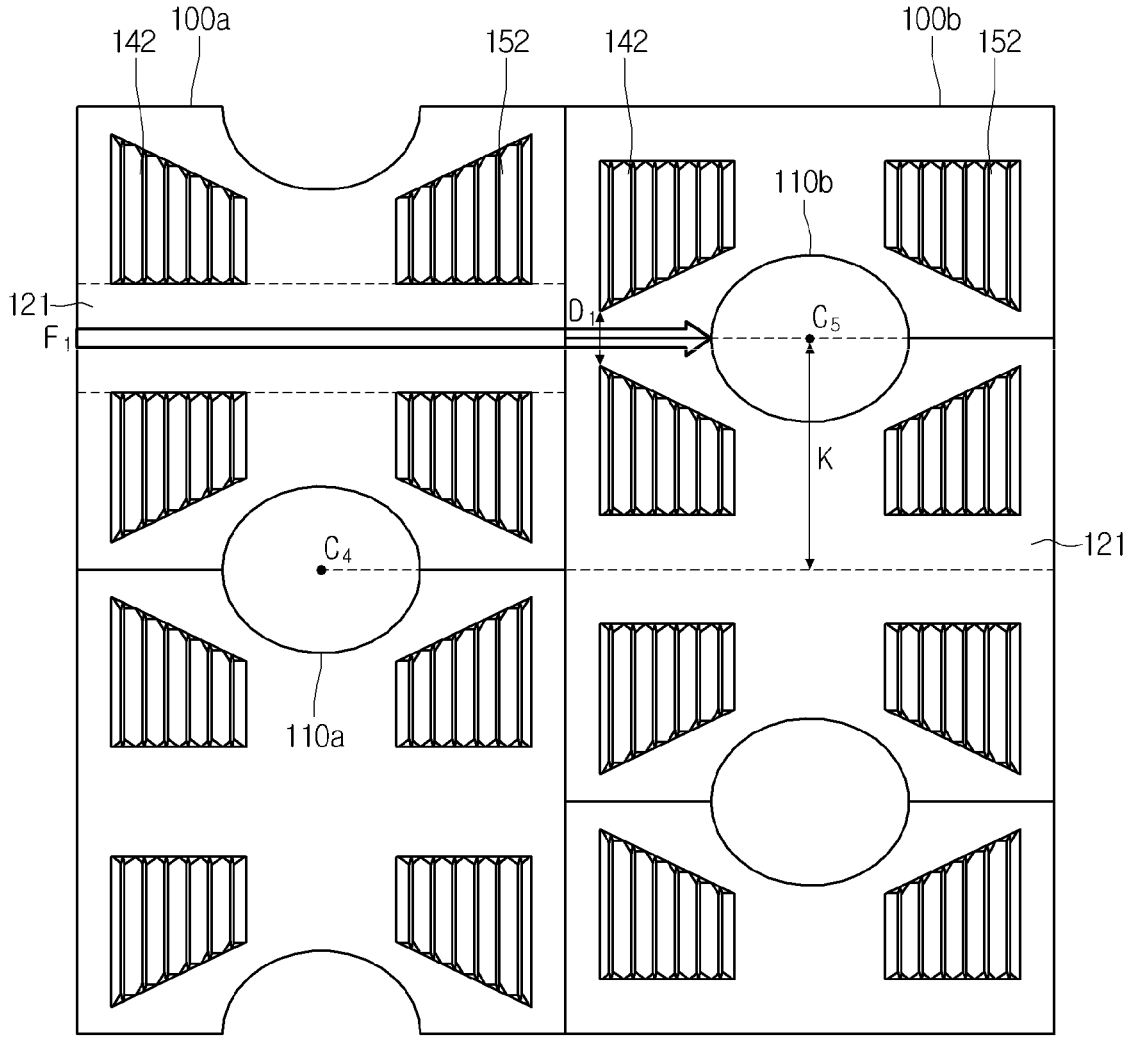
FIG. 5 is a view of a state in which the fin is arranged in two rows according to the first embodiment.

FIG. 5 is a view of a state in which the fin is arranged in two rows according to the first embodiment.

Referring to FIGS. 1 and 5, a first heat exchange part 20 and a second heat exchange part 30 are disposed parallel to each other. Thus, it may be understood as a heat exchanger 10 in which each of the refrigerant tubes 50 and the fins 100 are arranged in two rows. FIG. 5 illustrates a state in which the fins 100 are arranged in two rows.

The fins 100 constituting the heat exchanger 10 include a first fin 100*a* and a second fin 100*b* disposed on a side of the first fin 100*a*. The first and second fins 100*a* and 100*b* may extend longitudinally to overlap each other. Descriptions with respect to a constitution of each of the first and second fins 100*a* and 100*b* will be derived from those with respect to the constitution of the fins of FIGS. 2 and 3.

However, as shown in FIG. 5, the first and second fins 100*a* and 100*b* may be disposed so that tube through holes 110 are defined at heights different from each other.

In detail, the first fin 100*a* includes a plurality of tube through holes 110*a* through which the refrigerant tube 50 passes and first and second louvers 142 and 152 which are disposed between the plurality of tube through holes 110*a*. Also, a first plane part 121 may extend transversely to partition the plurality of first louvers 142 and the plurality of second louvers 152.

The second fin 100*b* includes a plurality of tube through holes 110*b* through which the refrigerant tube 50 passes and first and second louvers 142 and 152 which are disposed between the plurality of tube through holes 110*b*. Also, a first plane part 121 may extend transversely to partition the plurality of first louvers 142 and the plurality of second louvers 152.

The tube through hole 110*a* of the first fin 100*a* and the tube through hole 110*b* of the second fin 110*b* are defined at heights different from each other. That is to say, a center C4 of the tube through hole 100*a* and a center C5 of the tube through hole 110*b* are defined at heights different from each other. That is, the centers C4 and C5 may have a predetermined spaced height K therebetween.

Also, a spaced portion (or area) between the plurality of first louvers 142 is disposed on a side of the first plane part 121 of the first fin 100*a*. Here, the spaced portion may be a portion of the fin body 101 as a portion corresponding to a spaced distance D1 in FIG. 5.

Thus, air F1 introduced into a side of the first fin 100*a* passes through the first plane part 121 of the first fin 100*a* to flow into the tube through hole 110*b* of the second fin 100*b* via the spaced portion. That is, since high speed air flowing along the first plane part 121 of the first fin 100*a* disposed in a first row directly acts on the refrigerant tube disposed in a second row, a heat exchange amount of the refrigerant tube 50 disposed in the second row may increase.

Figure 6:
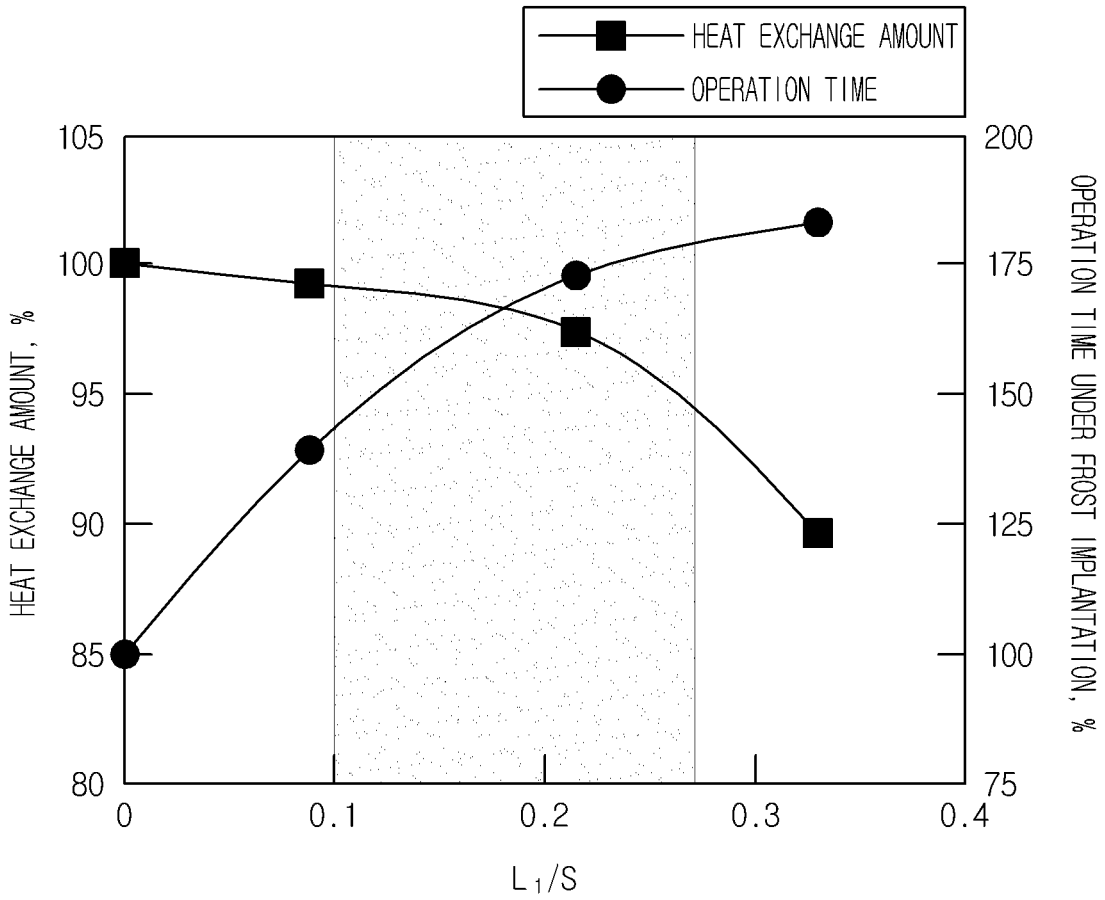
FIG. 6 is a graph illustrating heat exchanger performance depending on a size of the first plane part of the fin according to the first embodiment.
Figure 7:
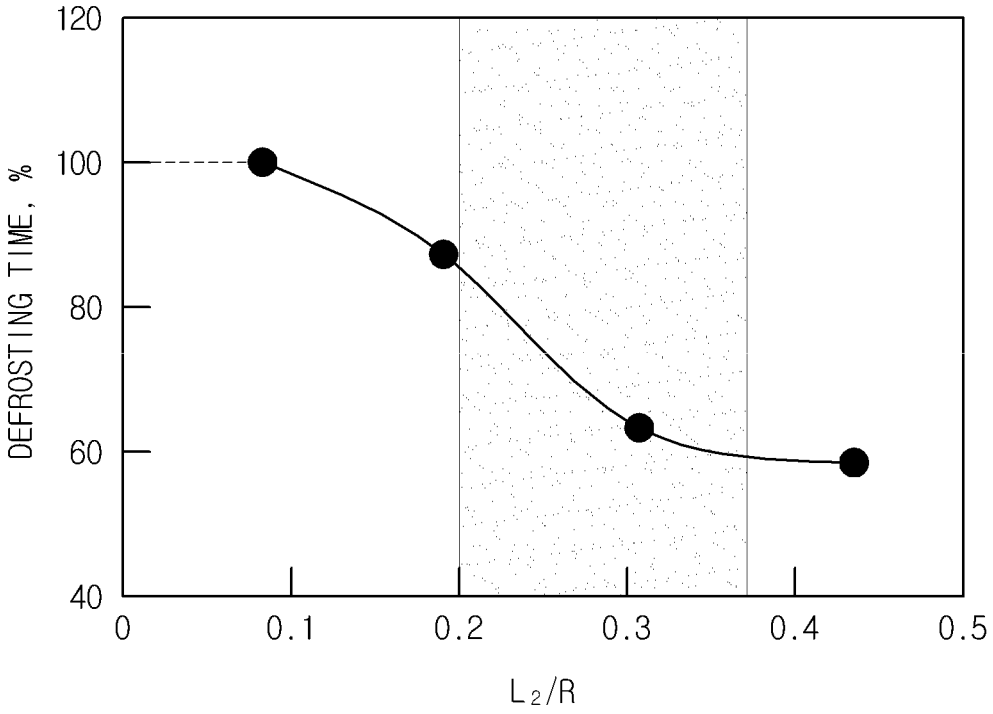
FIG. 7 is a graph illustrating heat exchanger performance depending on a size of a second plane part of the fin according to the first embodiment.
Figure 8:
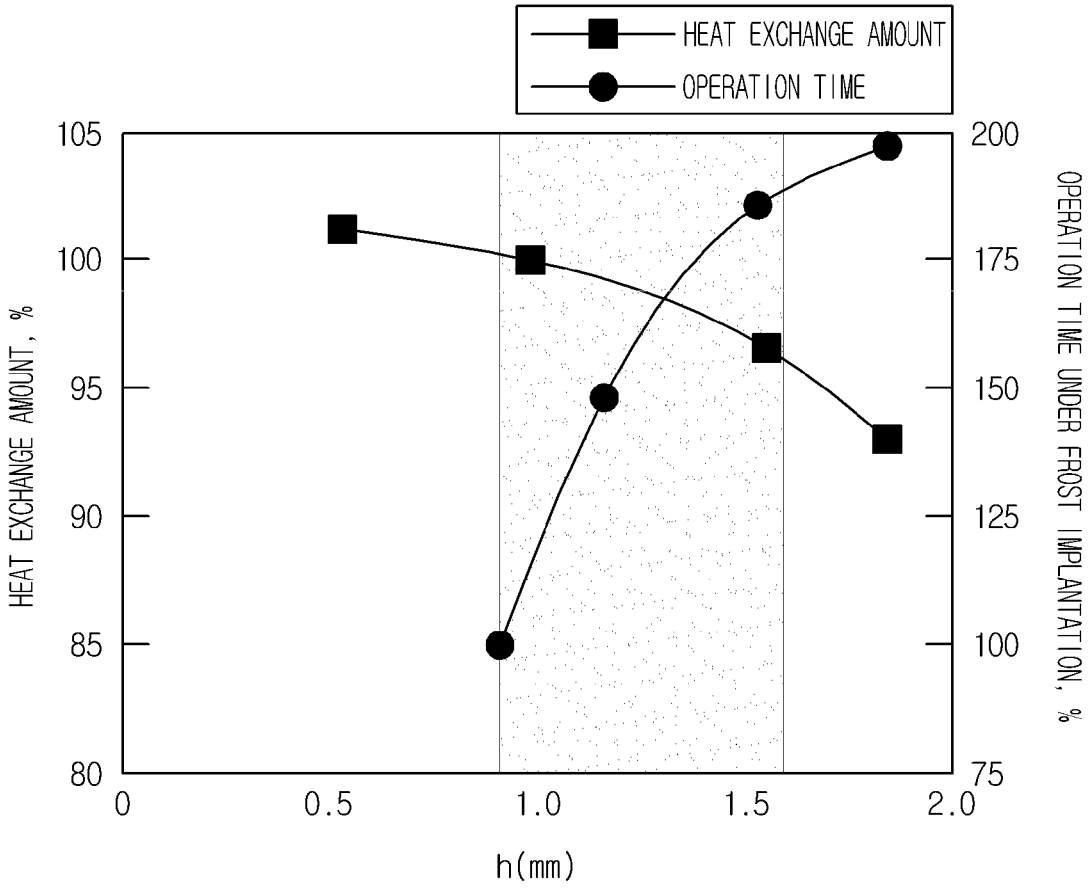
FIG. 8 is a graph illustrating heat exchanger performance depending on a distance between stacked fins according to the first embodiment.

FIG. 6 is a graph illustrating heat exchanger performance depending on a size of the first plane part of the fin according to the first embodiment, FIG. 7 is a graph illustrating heat exchanger performance depending on a size of a second plane part of the fin according to the first embodiment, and FIG. 8 is a graph illustrating heat exchanger performance depending on a distance between stacked fins according to the first embodiment.

Referring to FIGS. 3 and 6, an X-axis value of the graph represents a ratio (L1/S) of a longitudinal width of the first plane part 121 to the distance between the center C1 of the one tube through hole 110 and the center C2 of the other tube through hole 110 adjacent to the one tube through hole 110. Also, a Y-axis value represents values with respect to a heat exchange amount of the heat exchanger 20 and a continuous operation time of the heat exchanger 20 until the defrosting operation is performed according to variation of the X-axis value. Here, the continuous operation time represents a time at which the heat exchanger operates without performing the defrosting operation, i.e., an operation time between one defrosting time and the other defrosting time.

As described above, as the ratio L1/S increases, an area of the first plane part 121 decreases. Thus, a heat exchange amount may be reduced somewhat. In FIG. 6, it may be seen that the heat exchange amount is reduced as the ratio L1/S increases if it is assumed that the heat exchange amount of the heat exchanger 10 is 100% when L1 is zero, i.e., the area of the first plane part 121 is zero.

On the other hand, as the ratio L1/S increases, an air flow amount between the stacked fins increases. Thus, an amount of frost implanted on the fins 100 may be reduced. Thus, the continuous operation time of the heat exchanger 20 till a time point at which the defrosting operation is required may increase. In FIG. 6, it may be seen that an operation time increases as the ratio L1/S increases if it is assumed that the operation time is 100% when the L1 is zero.

That is, as the ratio L1/S increases, the heat exchange amount and the operation time have different distributions. Thus, a range of the ratio L1/S that is capable of adequately securing the two performances is proposed. As shown in FIG. 6, when $0.1<L1/S<0.28$ is satisfied, it is seen that the performance in which the heat exchange amount and the operation time are adequate is obtained.

Referring to FIGS. 3 and 7, an X-axis value of the graph represents a distance from one end (e.g., a left end) of the fin 100 to the other end (e.g., a right end), i.e., a ratio L2/R of a transverse width of the second plane part 131 to a width R of the fin 100. Also, a Y-axis value represents a value with respect to the defrosting time of the heat exchanger 20 according to variation of the X-axis value.

As described above, as the ratio L2/S increases, an area of the second plane part 131 increases. Thus, the defrosting operation may be quickly performed. In FIG. 7, it may be seen that the defrosting time is reduced as the ratio L2/S increases if it is assumed that the defrosting time is 100% when the L2 is zero, i.e., the area of the second plane part 131 is zero.

However, since an area of the first or second louver 142 or 152 decreases as the ratio L2/R increases, the heat exchange amount of the fin 100 may be relatively reduced. Thus, the ratio L2/R may be restricted to a value less than a predetermined value within a range in which the defrosting operation is quickly performed.

Thus, in FIG. 7, $0.2<L2/R<0.35$ is proposed so that the louvers 142 and 152 each having a predetermined area or more are formed, and simultaneously, the defrosting operation is quickly performed.

Referring to FIG. 8, the X-axis value of the graph represents a distance h (see FIG. 4) between one fin and the other fin adjacent to the one fin among the plurality of stacked fins. Also, a Y-axis represents values with respect to a heat exchange amount of the heat exchanger 20 and a continuous operation time of the heat exchanger 20 until the defrosting operation is performed according to variation of the X-axis.

As described above, as the distance h increases, the distance between the fins increases. Thus, the heat exchange amount may be reduced somewhat. In FIG. 8, it may be seen that the heat exchange amount decreases as the distance h increases if it is assumed that the heat exchange amount of the heat exchanger 10 is 100% when the distance h is about 0.5 mm.

On the other hand, as the distance h increases, an air flow amount between the stacked fins increases. Thus, an amount of frost implanted on the fins 100 may be relatively reduced. Thus, the continuous operation time of the heat exchanger 20 till a time point at which the defrosting operation is required may increase. In FIG. 8, it may be seen that an operation time increases as the distance h increases if it is assumed that the operation time is 100% when the distance h is about 0.08 mm.

That is, as the distance h increases, the heat exchange amount and the operation time have different distributions. Thus, a range of the distance h that is capable of adequately securing the two performances is proposed. As shown in FIG. 8, when 0.8 mm<h<1.6 mm is satisfied, it is seen that the performance in which the heat exchange amount and the operation time are adequate is obtained.

Also, when the fin distance h is in the above-described range, an FPI, a pitch P, and a louver angle θ may have a range value as follows. Here, the FPI (fin per inch) may be understood as the number (stacked number) of heat exchange fins per 1 inch.

The range value may be expressed as follows: $12 \leq FPI \leq 15$, $0.8 \leq P \leq 1.2$ mm, $27° \leq \theta \leq 45°$.

Figure 9:
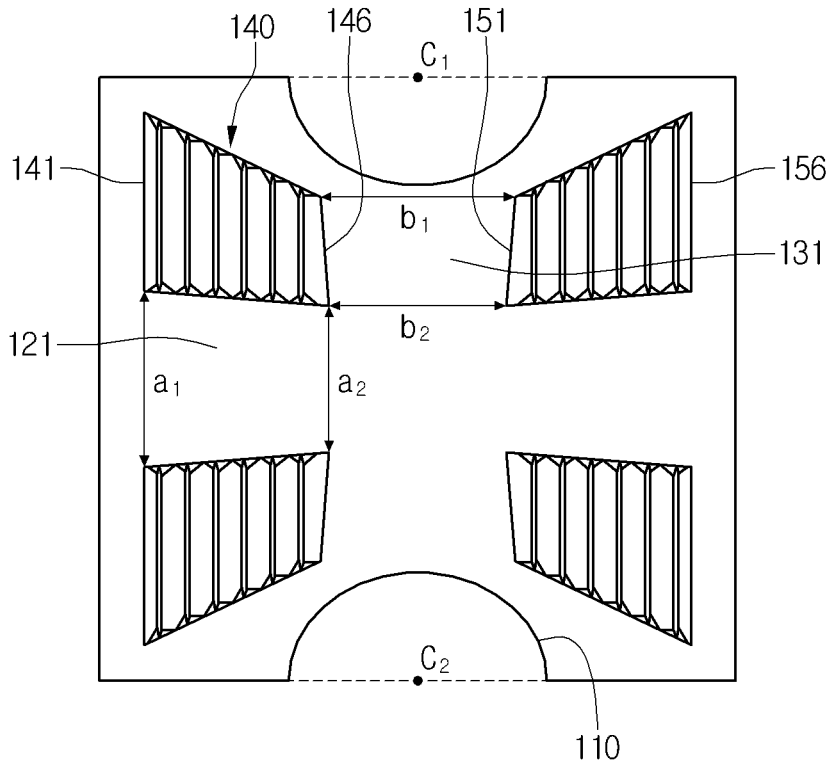
FIG. 9 is a view of a fin according to a second embodiment.

FIG. 9 is a view of a fin according to a second embodiment.

Referring to FIG. 9, a fin 100 according to a second embodiment includes first flow guides 140 and second flow guides 150 which are disposed on both sides with respect to a longitudinal central line of the fin 100.

Each of the first flow guides 140 includes a first front part 141 adjacent to one end of the fin 100 and a first rear end 146 adjacent to the longitudinal central line. Also, each of the second flow guides 150 includes a second rear end 156 adjacent to the other end of the fin 100 and a second front end 151 adjacent to the longitudinal central line.

A first plane part 121 partitioning the first flow guides 140 is disposed between the plurality of first flow guides 140. The first plane part 121 may have different widths. That is, a boundary surface of the first plane part 121 may inclinedly extend. Thus, a width a1 at one point of the first plane part 121 may be greater or less than that a2 at the other point.

Here, the width a1 may correspond to a distance between the first front part 141 of one first flow guide 140 and the first front part 141 of the other first flow guide 140, and the width a2 may correspond to a distance between the first rear end 146 of one first flow guide 140 and the first rear end 146 of the other first flow guide 140.

As described above, when the first plane part 121 has different widths, for example, when a1>a2 is satisfied, a flow rate of air may increase to increase an air flow amount. On the other hand, when a1<a2 is satisfied, a heat exchange area between air and the first plane part 121 may increase to increase a heat exchange amount.

A second plane part 131 is disposed on the first flow guide 140 and the second flow guide 150. The second plane part 131 may have different widths. That is, a boundary surface of the second plane part 131 may inclinedly extend. Thus, a width b1 at one point of the second plane part 131 may be greater or less than that b2 at the other point.

Here, the width b1 may correspond to a distance between an upper portion of the first rear end 146 of the first flow guide 140 and an upper portion of the second front end 151 of the second flow guide 150, and the width b2 may correspond to a distance between a lower portion of the first rear end 146 of the first flow guide 140 and a lower portion of the second front part 146 of the second flow guide 150.

As described above, when the second plane part 131 has width different from each other, for example, when b1>b2 is satisfied, defrosting water is collected while dropping down to increase a discharge rate of the defrosting water. On the other hand, when b1<b2 is satisfied, a flow area of the defrosting water may increase.

Hereinafter, third to sixth embodiments will be described. These embodiments are different the first embodiment in that a "guide part" for improving heat transfer performance and defrosting performance is provided in the constitution of the fin according to the first embodiment. Thus, different points will be mainly described, and descriptions and reference numerals with respect to the same part as the first embodiment are derived from those of the first embodiment.

Figure 10:
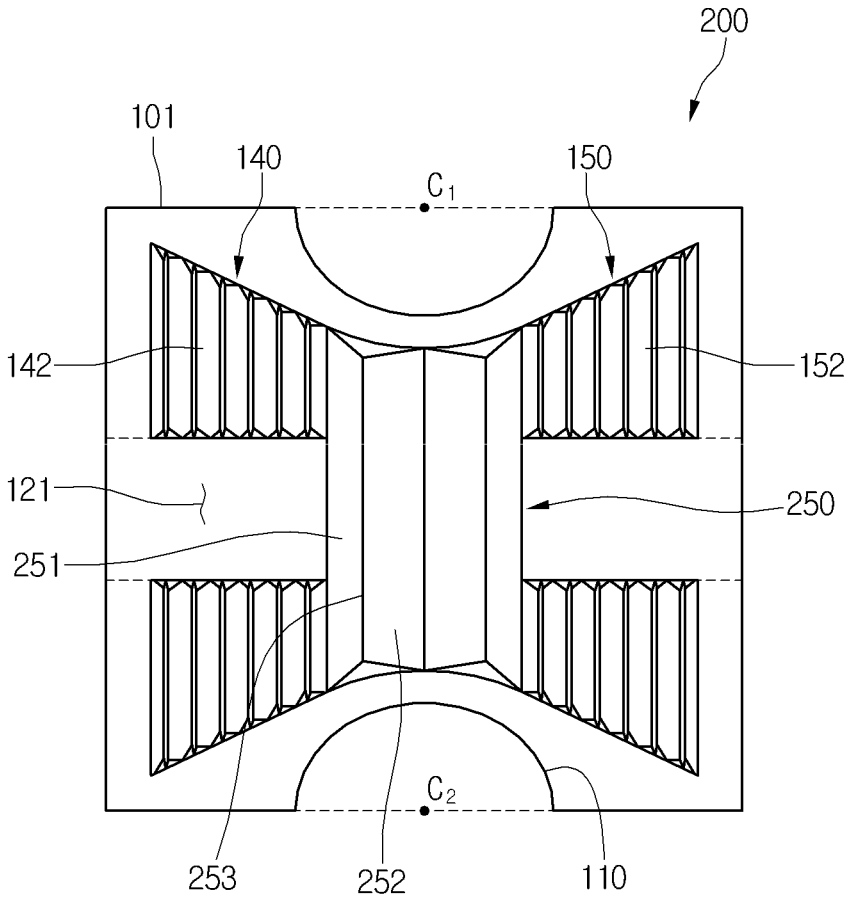
FIG. 10 is a view of a fin according to a third embodiment.

FIG. 10 is a view of a fin according to a third embodiment.

Referring to FIG. 10, in a fin 200 according to a third embodiment, the first and second plane parts 121 and 131 described in the first embodiment are cross each other, and a guide part 250 for guiding discharge of defrosting water is disposed on plane parts 121 and 131. The guide part 250 extends to cross the first plane part 121.

The guide part 250 protrudes from the second plane part 131 to longitudinally extend from one tube through hole 110 toward the other tube through hole 110. For example, the guide part 250 may be disposed to cover at least one portion of the second plane part 131.

In detail, the guide part 250 includes a first inclined surface 251 inclinedly protruding from a fin body 101 in one direction, a second inclined surface 252 inclinedly protruding from the fin body 101 in the other direction, and a tip part 253 connecting the first inclined surface 251 to the second inclined surface 252.

The tip part 253 protrudes from one surface of the fin body up to the uppermost position of the fin body 101. Each of the first and second inclined surfaces 251 and 252 inclinedly extend from one surface of the fin body 101 toward the tip part 253. At least one of the first inclined surface 251, the second inclined surface 252, and the tip part 253 extends in a longitudinal direction.

On the other hand, the first inclined surface 251 inclinedly extends upward from the fin body 101, and the second inclined surface 252 inclinedly extends downward toward the fin body 101. The tip part 253 defines a boundary between the first inclined surface 251 and the second inclined surface 252.

Each of the first inclined surface 251, the second inclined surface 252, and the tip part 253 may be provided in plurality. Here, the plurality of each of the first inclined surface 251, the second inclined surface 252, and the tip part 253 may be alternately disposed.

Also, a height at which the tip part 253 protrudes from the one surface of the fin body 101 may be greater than that at which a first or second louver 142 or 152 protrudes from one surface of the fin body 101.

Thus, since defrosting water generated during an defrosting operation of a heat exchanger 10 may be easily discharged downward along the first and second inclined surfaces 251 and 252, a defrosting time may be reduced, and thus, an operation time of the heat exchanger 10 may increase.

Also, since a heat exchange area between air and the fin 100 increases by the guide part 250, heat transfer performance of the heat exchanger 10 may be improved somewhat.

Figure 11:
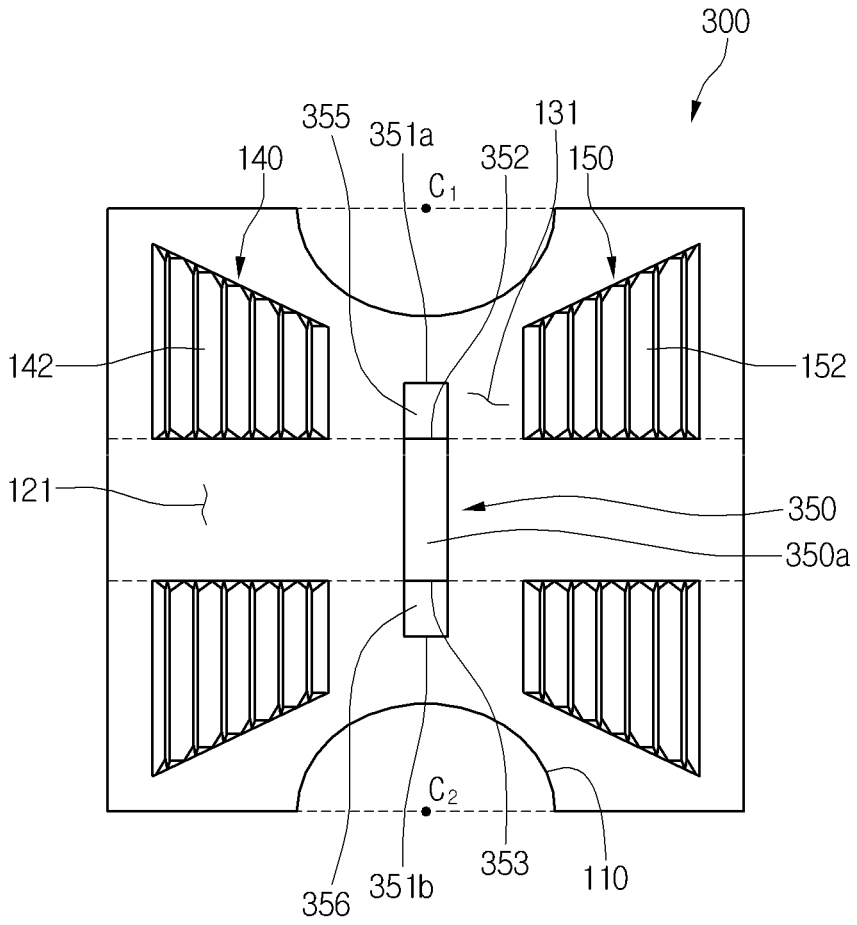
FIG. 11 is a view of a fin according to a fourth embodiment.

FIG. 11 is a view of a fin according to a fourth embodiment.

Referring to FIG. 11, a fin 300 according to a fourth embodiment includes a guide part 350 that is provided on plane parts 121 and 131 to guide a flow of air. The guide part 350 may longitudinally extend along the second plane part 131.

The guide part 350 includes a central portion 350*a* having the same surface as the first plane part 121 and a plurality of cutoff portions 352 and 353 that are defined by cutting at least portions of the fin body 101. The central portion 350*a* may be understood as at least one portion of the first or second plane part 121 or 131.

The plurality of cutoff portions 352 and 353 include first and second cutoff portions 352 and 353 which are respectively disposed on upper and lower portions of the guide part.

The guide part 350 includes a first end 351*a* defining an upper end of the guide part 350 and a first inclined surface 355 inclinedly extending from the first end 351*a* toward the first cutoff portion 352. Also, the guide part 350 includes a second end 351*b* defining a lower end of the guide part 350 and a second inclined surface 356 inclinedly extending from the second end 351*b* toward the second cutoff portion 353. In detail, the first inclined surface 355 may inclinedly extend from the first end 351*a* in one direction (a rear direction in FIG. 11), and the second inclined surface 356 may inclinedly extend from the second end 351*b* in the one direction. The extending direction of the first inclined surface 355 may be opposite to that of the second inclined surface 356.

In summary, the guide part 350 may include the inclined surfaces inclinedly extending in the one direction by cutting at least portions of the plane parts 121 and 131. Due to the constitutions of the cutoff portion and the inclined surface, it may be understood that at least one slit is provided on the fin 300. According to the constitutions of the fin according to the current embodiment, the heat exchange area may increase while air flows along the fin 100 to improve heat exchange efficiency.

Although the guide part 350 longitudinally extends on the second plane part 131 in the drawings, the present disclosures is not limited thereto. For example, the guide part 350 may transversely extend on the first plane part 121.

Figure 12:
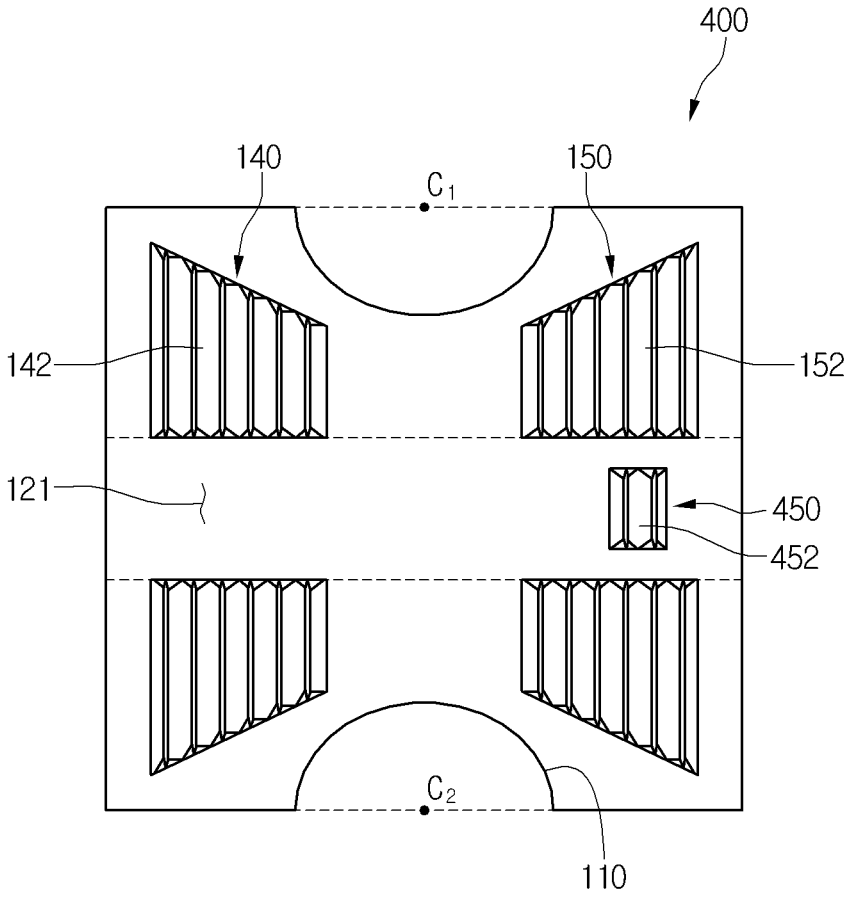
FIG. 12 is a view of a fin according to a fifth embodiment.

FIG. 12 is a view of a fin according to a fifth embodiment.

Referring to FIG. 12, a fin 400 according to a fifth embodiment includes a guide part 450 for guiding a flow of air.

In detail, the guide part 450 includes a third louver 452 that is similar to the first or second louver 142 or 152 described in the first embodiment. At least one portion of the first plane part 121 is cut and then bent in one direction (e.g., a front direction) and the other direction (e.g., a rear direction) of the fin 10 to manufacture the third louver 452.

Since the third louver 452 is provided on the first plane part 121, a heat exchange area between air and the fin 100 may increase.

Although the third louver 452 is provided on the first plane part 121 in FIG. 12, the present disclosure is not limited thereto. For example, the third louver 452 may be provided on the second plane part 131.

Figure 13:
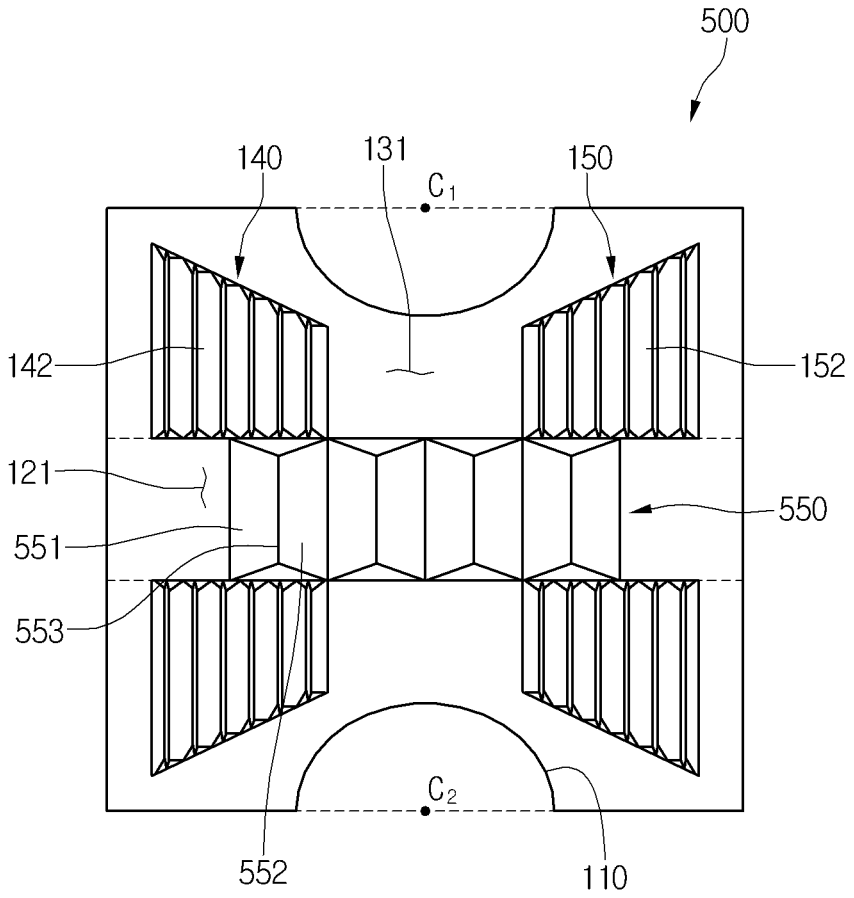
FIG. 13 is a view of a fin according to a sixth embodiment.

FIG. 13 is a view of a fin according to a sixth embodiment.

Referring to FIG. 13, a fin 500 according to a sixth embodiment includes a guide part 550 for guiding a flow of air. The guide part 550 is disposed to cover at least one portion of a first plane part 121 to extend corresponding or parallel to a direction in which the air flows.

The guide part 550 includes a first inclined surface 551 protruding from one surface of the fin 200 in one direction, a second inclined surface 552 protruding from the one surface of the fin 500 in the other direction, and a tip part 553 connecting the first inclined surface 551 to the second inclined surface 552.

Each of the first inclined surface 551, the second inclined surface 552, and the tip part 553 may be provided in plurality. Here, the plurality of each of the first inclined surface 251, the second inclined surface 252, and the tip part 253 may be alternately disposed.

The guide part 550 may transversely extend along the first plane part 121. That is, the guide part 550 according to the current embodiment may be understood that the guide part 250 of FIG. 10 is disposed on the first plane part 121 to extend in a direction (e.g., a transverse direction) crossing the second plane part 131.

Due the constitution of the guide 550, defrosting water may be easily discharged, and a contact area, i.e., a heat exchange area between air and the fin 500 may increase.

According to the embodiments, since the plane part for guiding the air flow is provided on the fin, the frost implantation on the fin may be delayed. Also, the air flow may be improved to increase an amount of air passing through the heat exchanger and reduce a loss of a pressure applied to the heat exchanger.

Also, the plane part for guiding the discharge of the condensed water may be provided on the fin to reduce the defrosting time. Thus, when the heat exchanger is used in the air conditioner, the heating time and performance of the air conditioner may be improved.

Also, in a case where the assembly of the refrigerant tube and the fin is arranged in two rows, since air directly contacts the refrigerant tube disposed in the rear row along the plane part disposed on in the front row, heat transfer performance in the rear row may be improved.

Also, each of the plane parts disposed on the fin may be provided to have an optimum size to improve the heat exchange amount of the heat exchanger and increase an operation time of the heat exchanger until the frost implantation occurs.

Also, since the guide part for guiding the flows of the air and defrosting water is provided on the plane part of the fin, the heat transfer performance and defrosting performance of the heat exchanger may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger comprising:

a refrigerant tube through which a refrigerant flows; and a fin having a plurality of tube through holes into which the refrigerant tube is inserted, wherein the fin comprises:

a fin body;

a plurality of louvers protruding from a surface of the fin body;

a plane part defined between the plurality of louvers, the plane part comprising a first plane part extending in a direction corresponding to an air flow direction, and a second plane part extending to cross the first plane part; and a guide part disposed on at least one side of the plane part to guide a flow of air, the guide part comprising:

a central portion configured to be a portion of the first or second plane part and having a flat surface;

a first cutoff portion disposed on an upper portion of the central portion;

a second cutoff portion disposed on a lower portion of the central portion;

a first end defining an upper end of the guide part;

a second end defining a lower end of the guide part;

a first inclined surface inclinedly extending from a first end of the guide part toward the first cutoff portion; and a second inclined surface inclinedly extending from a second end of the guide part toward the second cutoff portion.

2. The heat exchanger according to claim 1, wherein the first plane part extends from an end of one side of the fin body to an end of an opposing side of the fin body.

3. The heat exchanger according to claim 1, wherein the second plane part extends from a first tube through hole to a second tube through hole.

4. The heat exchanger according to claim 1, wherein the guide part is disposed to cover at least a portion of one of the first plane part or the second plane part.

5. The heat exchanger according to claim 1, wherein the extending direction of the first inclined surface is opposite to that of the second inclined surface.

6. The heat exchanger according to claim 1, wherein the guide part is a slit defined by cutting at least a portion of the fin body.

7. The heat exchanger according to claim 1, wherein the first inclined surface is bent from the first end and extends towards the upper portion of the central portion, and the second inclined surface is bent from the second end and extends towards the lower portion of the central portion.

* * * * *